US008115652B2

(12) United States Patent
Lee

(10) Patent No.: US 8,115,652 B2
(45) Date of Patent: Feb. 14, 2012

(54) METHOD AND APPARATUS FOR VEHICLE DRIVING GUIDE

(76) Inventor: Kang Lee, Taipei (TW)

( * ) Notice: Subject to any disclaimer, the term of this patent is extended or adjusted under 35 U.S.C. 154(b) by 505 days.

(21) Appl. No.: 12/360,546

(22) Filed: Jan. 27, 2009

(65) Prior Publication Data

US 2010/0156668 A1 Jun. 24, 2010

(30) Foreign Application Priority Data

Dec. 19, 2008 (CN) ..... 2008 1 0184401

(51) Int. Cl.
*G08G 1/09* (2006.01)

(52) U.S. Cl. ..... 340/905; 340/901

(58) Field of Classification Search ..... 340/905
See application file for complete search history.

(56) References Cited

U.S. PATENT DOCUMENTS 3,872,423 A * 3/1975 Yeakley ..... 340/932
5,509,082 A * 4/1996 Toyama et al. ..... 382/104
5,673,039 A * 9/1997 Pietzsch et al. ..... 340/905
6,094,444 A * 7/2000 Auer ..... 370/535
7,147,400 B2 * 12/2006 Van Der Poel ..... 404/9
7,898,433 B2 * 3/2011 Roberts ..... 340/932

* cited by examiner

*Primary Examiner* — George Bugg
*Assistant Examiner* — Kerri McNally
(74) *Attorney, Agent, or Firm* — Hershkovitz & Associates, LLC; Abraham Hershkovitz

(57) ABSTRACT

A method and an apparatus for vehicle driving guide with lamps are applied to a target road. The apparatus has a traffic condition detection module, multiple indication lamps and a signal control module. The traffic condition detection module obtains a traffic condition. The indication lamps are mounted separately on the target road. The signal control module is electrically connected to the traffic condition detection module and the indication lamps and operates the indication lamps according to a control process based on different traffic conditions. The control process may be in a chase mode that sequentially pulses the indication lamps on with a regulated moving direction of the target road with a pulse interval between turning the indication lamps on to present an impression that the lights are moving at an indicator speed. The impression allows drivers in vehicles on the target road to follow to drive.

8 Claims, 9 Drawing Sheets

METHOD AND APPARATUS FOR VEHICLE DRIVING GUIDE

BACKGROUND OF THE INVENTION

1. Field of the Invention

The present invention relates to a method and apparatus for vehicle driving guide, and more particularly to a method and an apparatus for vehicle driving guide with lamps.

2. Description of Related Art

Vehicle accidents result in deaths, injuries and financial losses. Especially on freeways, accidents happen frequently because vehicles move quickly. When a critical safe interval between lead and following vehicles is too short, a driver of following vehicle is unable to react to brake without contacting the lead vehicle.

However, drivers do not always keep watch for the critical safe interval so providing a system or method to prevent vehicle crashing is urgently required. Existing systems include supersonic radar systems, infrared radar systems, video capturing and analyzing systems or the like detecting intervals between vehicles and alerting when the intervals between vehicles are too short.

Existing systems further include intelligent traffic system (ITS). Vehicles equipped with ITS detect intervals from other vehicles, automatically and suitably adjust running speed and keep critical safe intervals from other vehicles. However, ITS still requires many improvements and must be added to each vehicle so only improves safety for cars having ITS and not all road users.

To overcome the shortcomings, the present invention provides a method and an apparatus for vehicle driving guide with lamps to mitigate or obviate the aforementioned problems.

SUMMARY OF THE INVENTION

The main objective of the invention is to provide a method and an apparatus for vehicle driving guide with lamps.

The method and the apparatus in accordance with the present invention are applied to a target road. The apparatus comprises a traffic condition detection module, multiple indication lamps and a signal control module. The traffic condition detection module obtains a traffic condition. The indication lamps are mounted separately on the target road. The signal control module is electrically connected to the traffic condition detection module and the indication lamps and operates the indication lamps according to a control process based on different traffic conditions. The control process may be in a chase mode that sequentially pulses the indication lamps on with a regulated moving direction of the target road with a pulse interval between turning the indication lamps on to present an impression that the lights are moving at an indicator speed. The impression allows drivers in vehicles on the target road to follow to drive.

The method comprises steps of providing traffic condition data, obtaining a traffic condition from the traffic condition data and operating multiple indication lamps on a target road according to a control process based on the traffic condition.

Other objectives, advantages and novel features of the invention will become more apparent from the following detailed description when taken in conjunction with the accompanying drawings.

DETAILED DESCRIPTION OF PREFERRED EMBODIMENT

Figure 1:
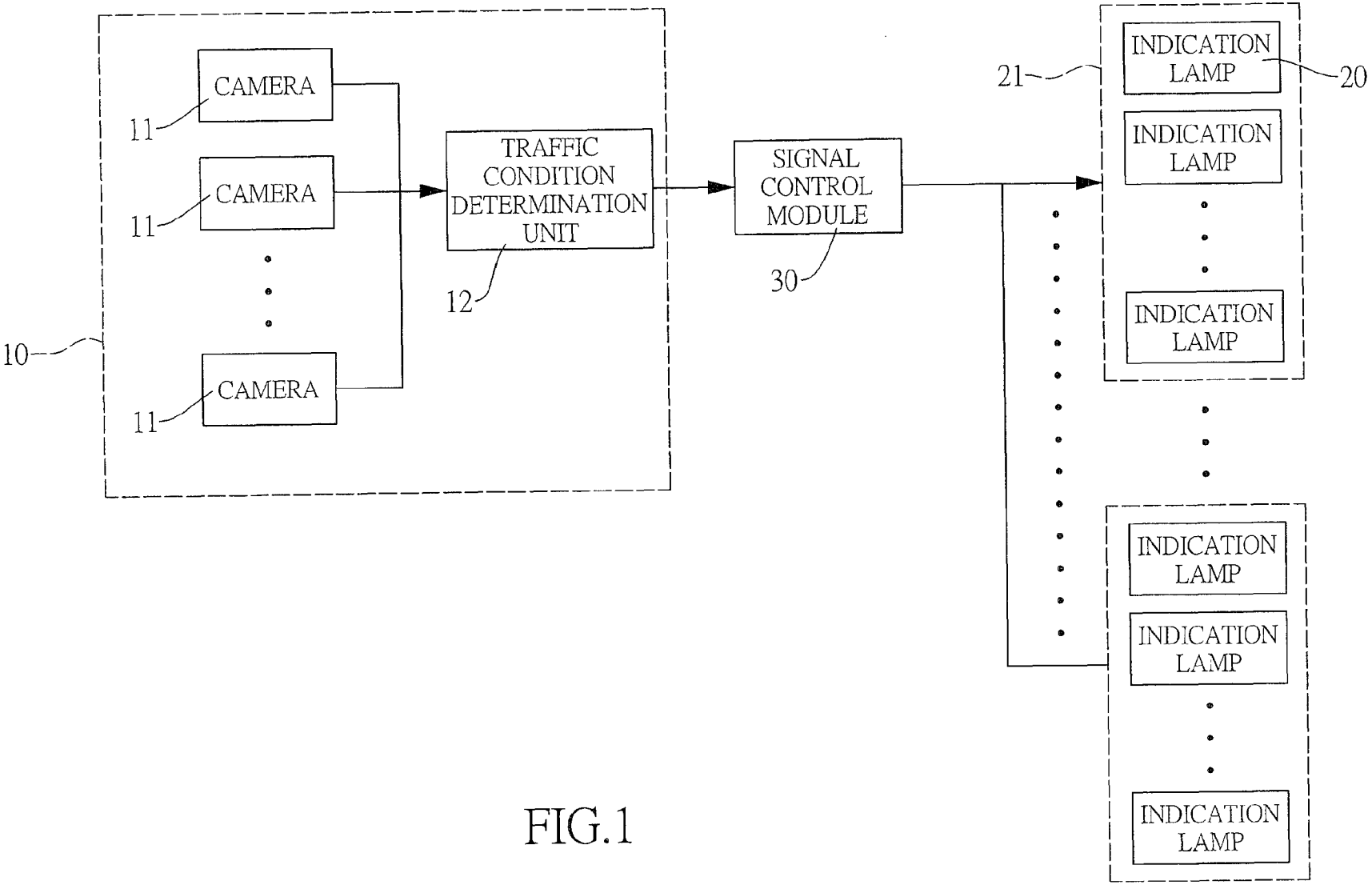
FIG. 1 is a functional block diagram of a first embodiment of an apparatus for vehicle driving guide in accordance with the present invention.

With reference to FIG. 1, an apparatus for vehicle driving guide in accordance with the present invention may be applied to roads such as freeways, highways or the like and comprises a traffic condition detection module (10), multiple indication lamps (20) and a signal control module (30).

The traffic condition detection module (10) obtains a traffic condition. Supersonic wave sensors, infrared sensors, inductive loop detectors, cameras (11) or the like may be used to capture the traffic condition and determine whether the traffic condition is smooth flowing traffic, heavy traffic, traffic jam or accident from analyzing the traffic conditions. When the traffic conditions are captured by cameras (11), the traffic condition detection module (10) may comprise multiple cameras (11) and a traffic condition determination unit (12).

The cameras (11) are mounted on a target road to capture traffic condition image data including vehicle images and background images.

The traffic condition determination unit (12) is electrically connected to the cameras (11) to receive the traffic condition image data, distinguishes the vehicle images from the background images in the traffic condition image data and determines the traffic condition by tracking the vehicle images and calculating at least one traffic speed from at least one vehicle in the vehicle images. For example, if the vehicle images show little or no net change, the traffic condition determination unit (12) determines the traffic condition to be traffic jam or accident. If the vehicle images show larger change and at least one vehicle is tracked to calculate a traffic speed, an average traffic speed is calculated from the at least one traffic speed and the traffic condition determination unit (12) determines the traffic condition to be smooth traffic when the average traffic speed is over a predetermined speed. If the average traffic speed is less than the predetermined speed, the traffic condition determination unit (12) determines the traffic condition to be heavy traffic. The predetermined speed may be selected for a portion of the target road and may be between 40 and 120 kilometers per hour. Preferably, the predetermined speed is about 80 kilometers per hour.

The indication lamps (20) are mounted separately, maybe equidistantly on the target road, such as on the roadside, in inner walls of a tunnel, underground maybe under lane markings or the like. Each indication lamp (20) may emit lights with various colors, such as green light, red light, yellow light or the like. Furthermore, the indication lamps (20) may be arranged into multiple lamp blocks (21).

Figure 2:
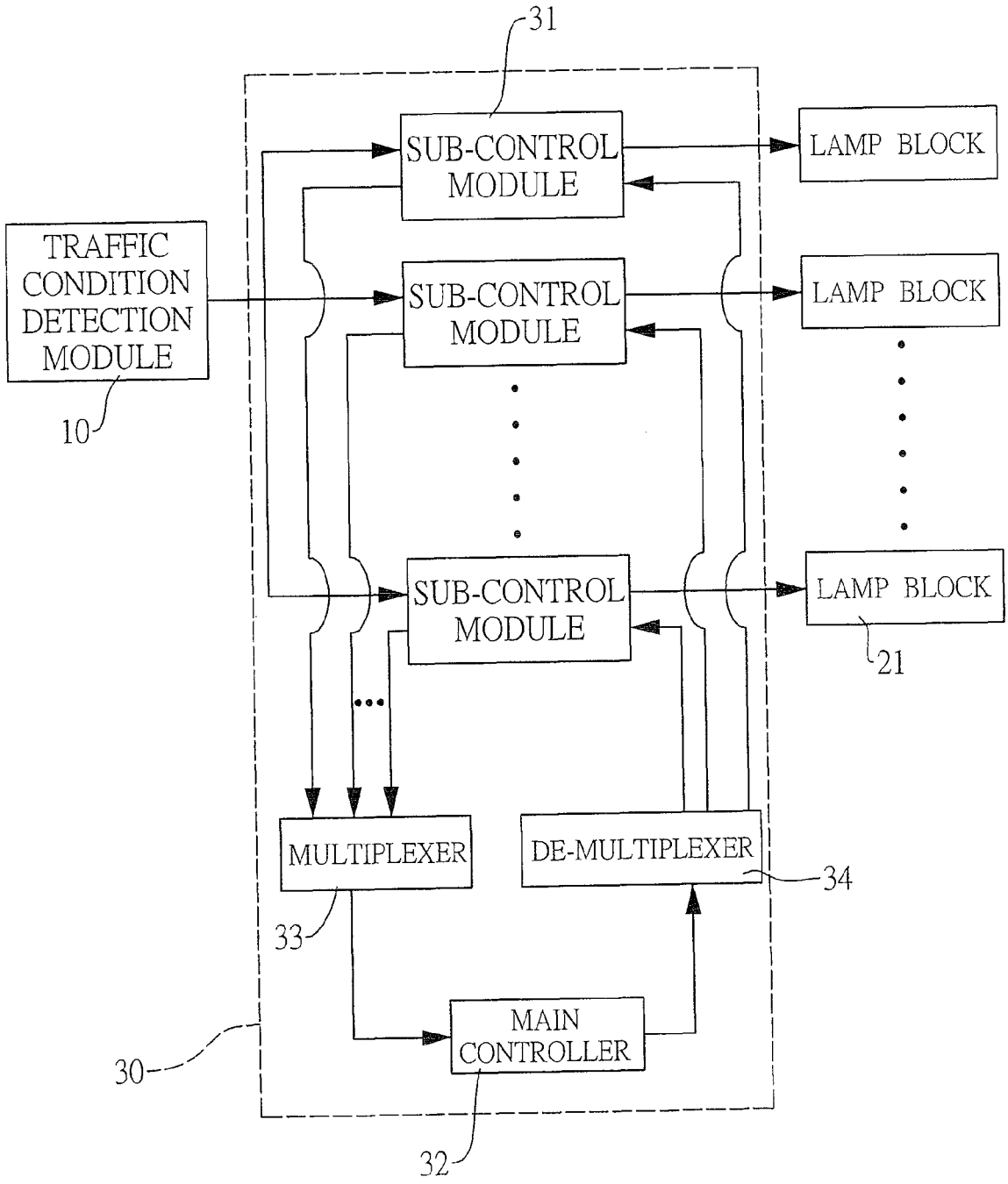
FIG. 2 is a functional block diagram of a signal control module in FIG. 1.
Figure 4:
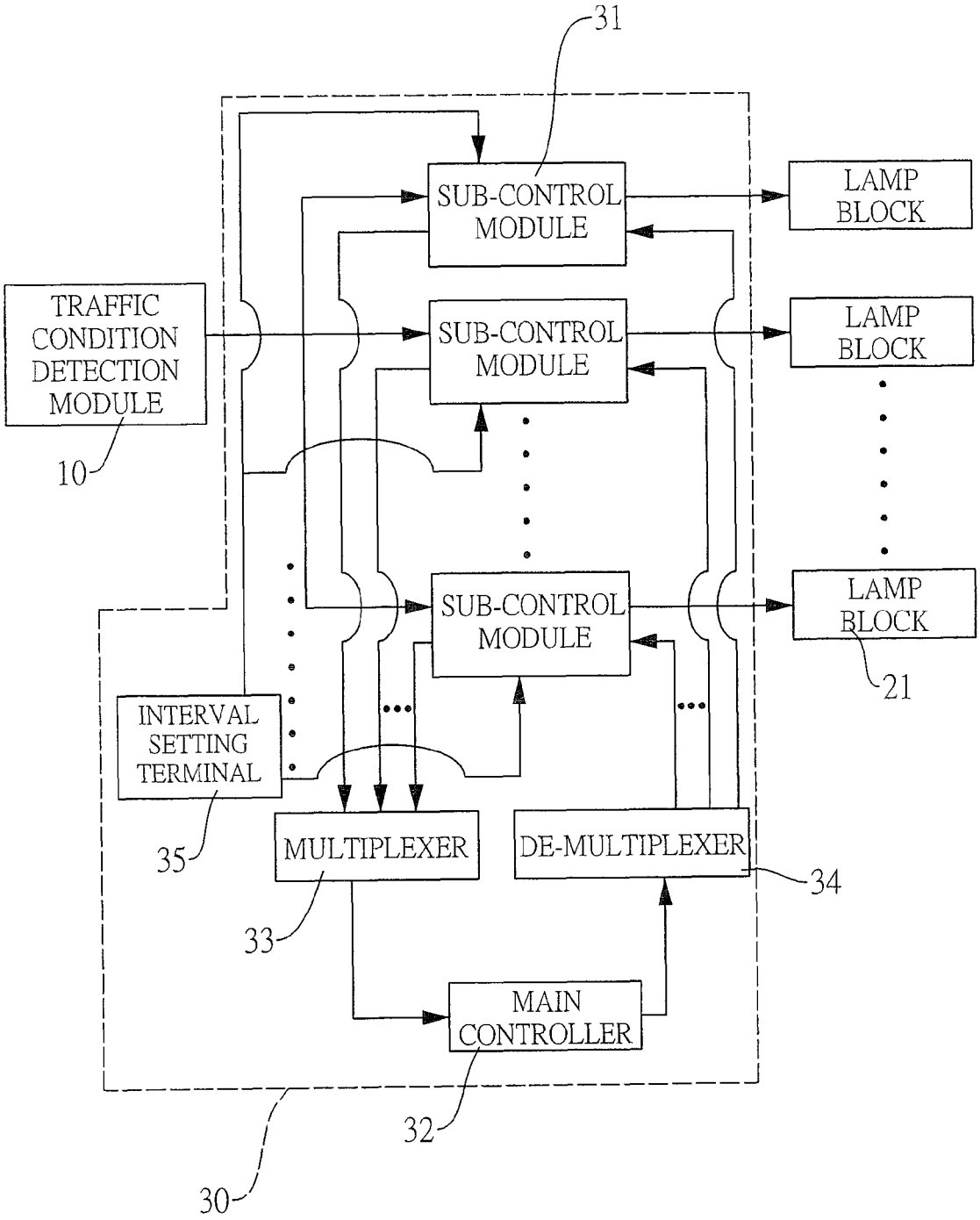
FIG. 4 is a functional block diagram of a signal control module in a second embodiment of an apparatus for vehicle driving guide in accordance with the present invention.

The signal control module (30) is electrically connected to the traffic condition detection module (10) and the indication lamps (20) and operates the indication lamps (20) according to a control process based on different traffic conditions to indicate the traffic condition to drivers. The control process may comprise a warning mode and a chase mode. The warning mode may be an all turn on mode or an intermittent mode respectively being all the indication lamps (20) on and all the indication lamps (20) pulsing. The chase mode sequentially pulses the indication lamps (20) on with a regulated moving direction of the target road with a pulse interval between turning the indication lamps (20) on. The pulse interval between pulsing the indication lamps (20) on is controlled by the signal module control (30) and may be pre-set, changed depending on traffic conditions or calculated from the average traffic speed. With further reference to FIGS. 2 and 4, the signal control module (30) comprises multiple sub-control modules (31), a main controller (32) and an optional interval setting terminal (35).

The sub-control modules (31) correspond respectively to the lamp blocks (21) and are electrically connected to the traffic condition detection module (10). Each sub-control module (31) is electrically connected to the indication lamps (20) in a corresponding lamp block (21), receives the traffic condition from the traffic condition detection module (10) and transmits a coordination signal based on the traffic condition.

The main controller (32) is connected to the sub-control modules (31) through a multiplexer (33) and a de-multiplexer (34). Because the vehicles move forward on the roads, when the control process is in the chase mode, exact operations of the indication lamps (20) in accordance with the control process is important. Therefore, after the main controller (32) receives the coordination signals from the sub-control modules (31) and arbitrates conflicts between the sub-control modules (31), the main controller (32) transmits enable signals respectively and differentially to the sub-control modules (31) to coordinately operate the sub-control modules (31).

The interval setting terminal (35) is electrically connected to the sub-control modules (31). The interval setting terminal (35) allows the pulse interval to be input or changed either continuously based on the average traffic speed or the traffic condition or set by a user.

Figure 3:
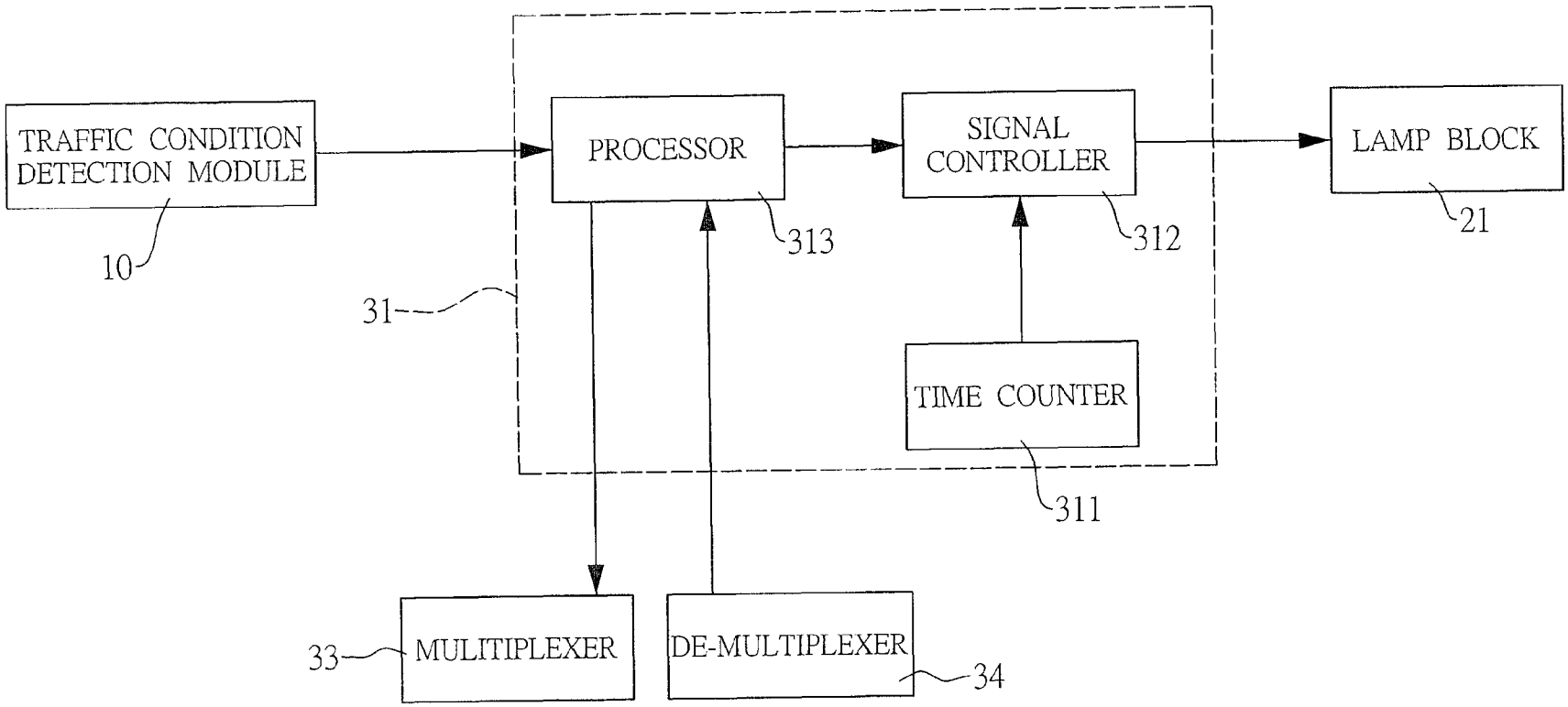
FIG. 3 is a functional block diagram of a sub-control module in the signal control module in FIG. 1.

With further reference to FIG. 3, each sub-control module (31) may further comprise a time counter (311), a signal controller (312) and a processor (313).

The signal controller (312) connects to the time counter (311) and the indication lamps (20) in a corresponding lamp block (21).

The processor (313) is electrically connected to the traffic condition detection module (10), the multiplexer (33), the de-multiplexer (34) and the signal controller (312). After receiving the traffic condition from the traffic condition detection module (10), the processor (313) transmits the coordination signal based on the traffic condition to the main controller (32) through the multiplexer (33). When receiving a corresponding enable signal from the main controller (32), the processor (313) transmits a driving signal to the signal controller (312) in a corresponding sub-control module (31). The signal controller (312) controls the indication lamps (20) in the corresponding lamp block (21) according to the control process.

When the control process is in the chase mode, the indication lamps (20) present an impression that the lights are moving at an indicator speed. The time counters (311) assist the signal controllers (312) of the sub-control modules (31) in the signal control module (30) in controlling and changing the pulse interval to change the indicator speed. Therefore, drivers can follow the indication lamps (20) to drive at the indicator speed safely. Decreasing the pulse interval increases the indicator speed and vice versa.

Figure 5:
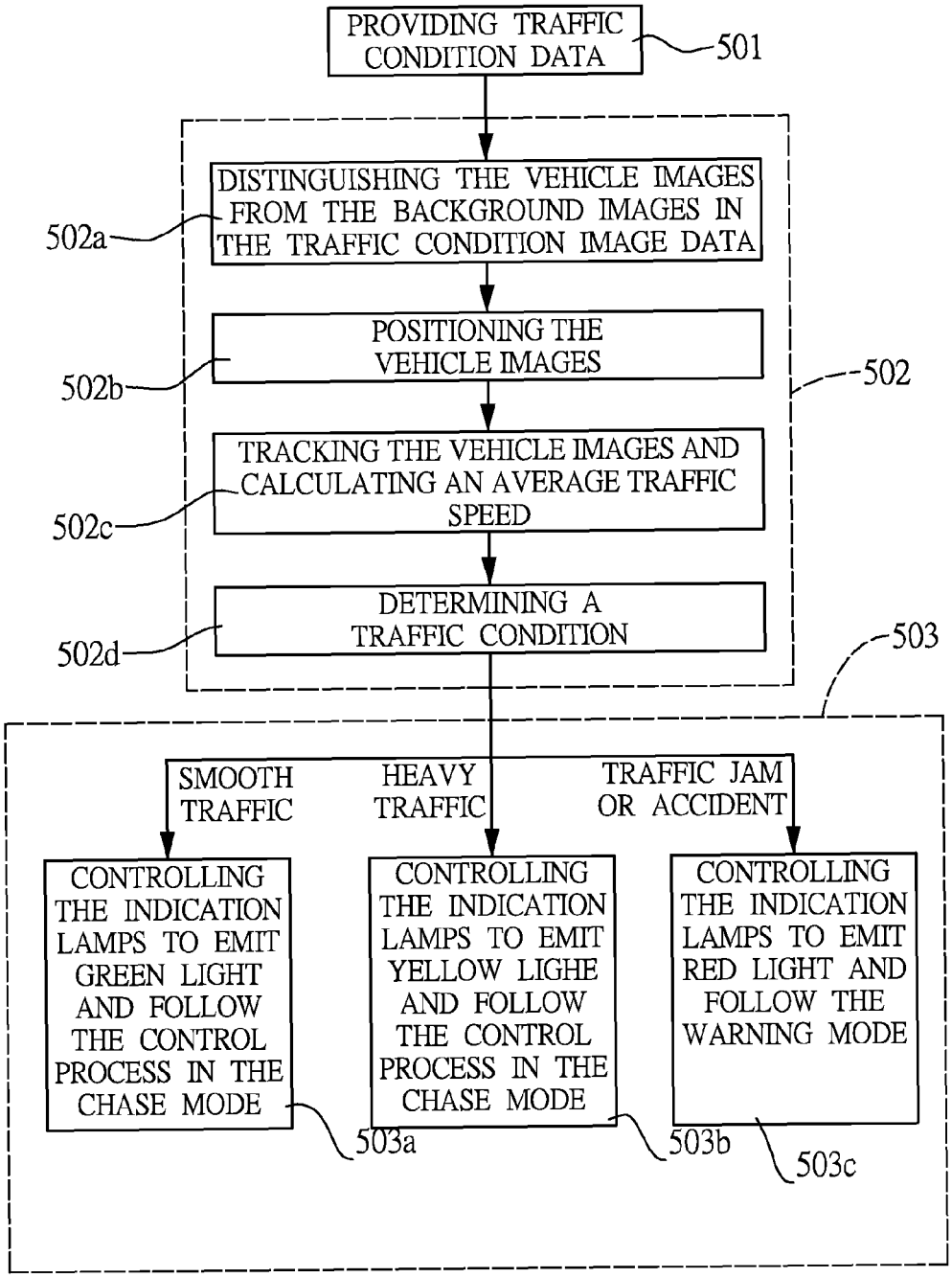
FIG. 5 is a flow chart of a control process executed by the signal control module in FIG. 2.

With further reference to FIG. 5, a method for vehicle driving guide in accordance with the present invention comprises steps of providing traffic condition data (501), obtaining a traffic condition (502) and operating multiple indication lamps on a target road according to a control process based on the traffic condition (503).

In the step of providing traffic condition data (501), traffic condition data are detected, maybe by multiple supersonic wave sensors, infrared sensors, inductive loop detectors, multiple cameras (11) or the like mounted on a target road. Preferably, cameras (11) are used to capture traffic condition image data including vehicle images and background images.

In the step of obtaining a traffic condition (502), traffic condition data are analyzed, and a traffic condition is obtained from the analyzed traffic condition data. The step of obtaining a traffic condition (502) may further comprise sub-steps of distinguishing the vehicle images from the background images in the traffic condition image data (502*a*), positioning the vehicle images (502*b*), tracking the vehicle images and calculating an average traffic speed (502*c*) and determining a traffic condition (502*d*).

In the sub-step of tracking the vehicle images and calculating an average traffic speed (502*c*), each of the at least one vehicle in the vehicle images is tracked through multiple frames, and the traffic speed of each at least one vehicle is calculated. An average traffic speed is further calculated from the at lease one traffic speed.

In the sub-step of determining a traffic condition (502*d*), a preferred embodiment is to allocate a predetermined speed. When the tracked vehicle images show little or not change, the traffic condition is determined to be traffic jam or accident. When the tracked vehicle images show larger change and the average traffic speed is greater than the predetermined speed, the traffic condition is determined to be smooth traffic. Otherwise, the traffic condition is determined to be heavy traffic. The predetermined speed may be 80 km/h.

The step of operating multiple indication lamps on a target road according to a control process based on the traffic condition (503) may further comprise sub-steps of controlling the indication lamps to emit green light and follow the control process in the chase mode (503*a*) when the traffic condition is smooth traffic, controlling the indication lamps to emit yellow light and follow the control process in the chase mode (503*b*) when the traffic condition is heavy traffic and controlling the indication lamps to emit red light and follow the warning mode (503*c*) when the traffic condition is traffic jam or accident.

Figure 6A:
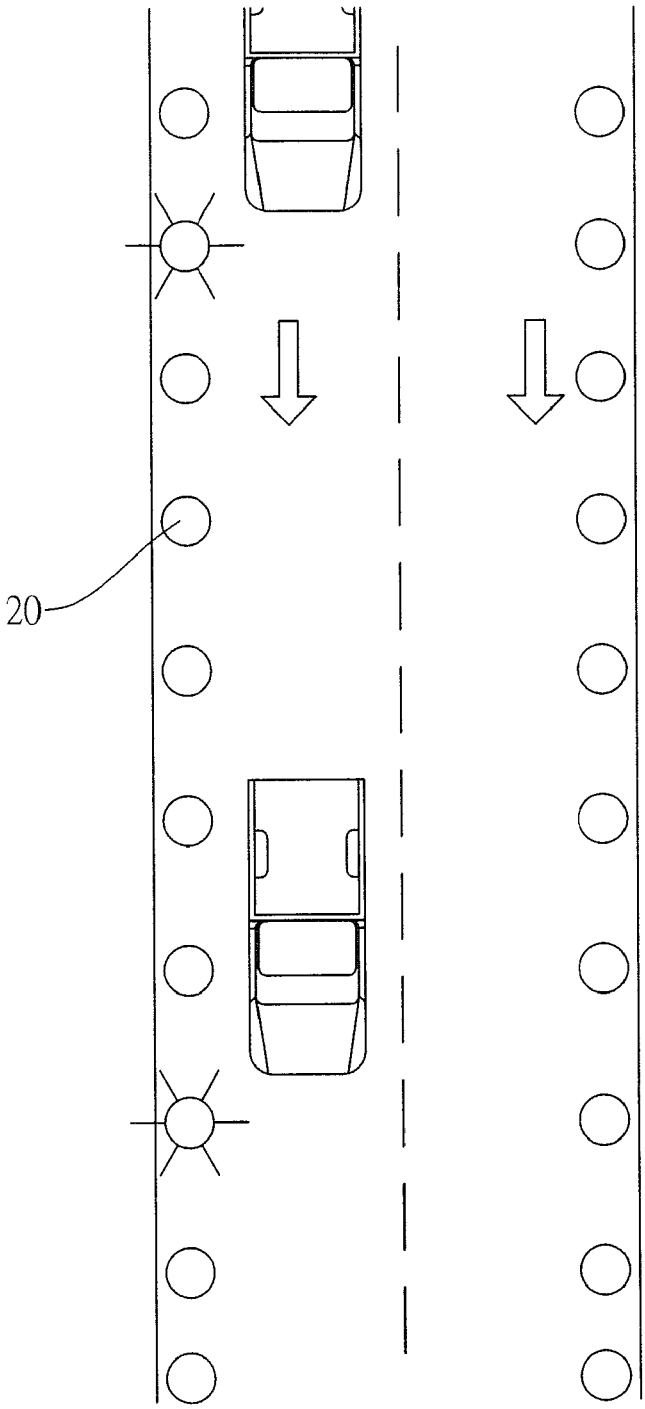
FIGS. 6A and 6B are sequential top views of vehicles traveling in smooth flowing traffic on a target road on which the apparatus for traffic speed guide in FIGS. 1 or 4 is applied.
Figure 6B:
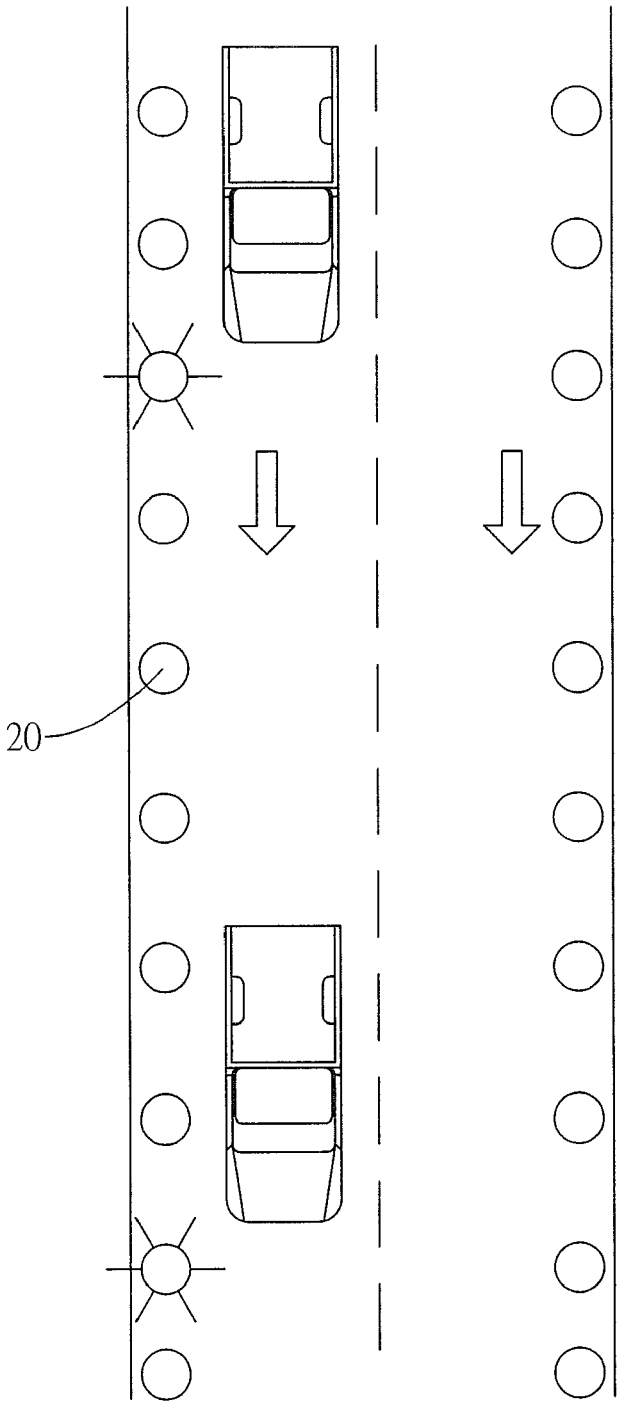

With further reference to FIGS. 6A and 6B, in the sub-step (503 *a*), the indicator speed is equivalent to the average traffic speed and at least one indication lamp (20) separates two the illuminated indication lamps (20). Therefore, the sub-step (503*a*) allows drivers to follow the green light from the indicator lamps (20) at the indicator speed and follow each other at a critical safe interval.

In the sub-step (503*b*), the indicator speed is equivalent to the average traffic speed and at least one indication lamp (20) separates two illuminated indication lamps (20). The yellow light warn the drivers that the traffic is heavy so they should slow down.

Figure 7:
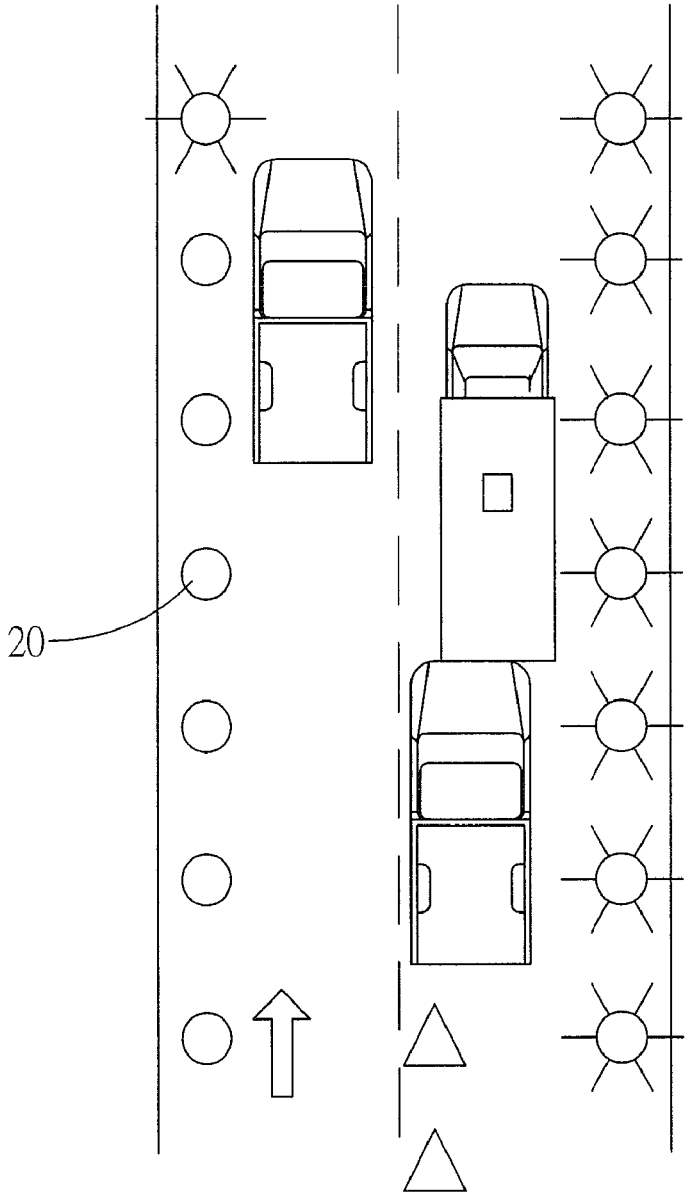
FIG. 7 is a top view of the target road in FIG. 6 during a crash.

With further reference to FIG. 7, in the sub-step (503*c*), the red indication lamps (20) in warning mode warn the drivers that traffic jam or accident may occur ahead.

Figure 8:
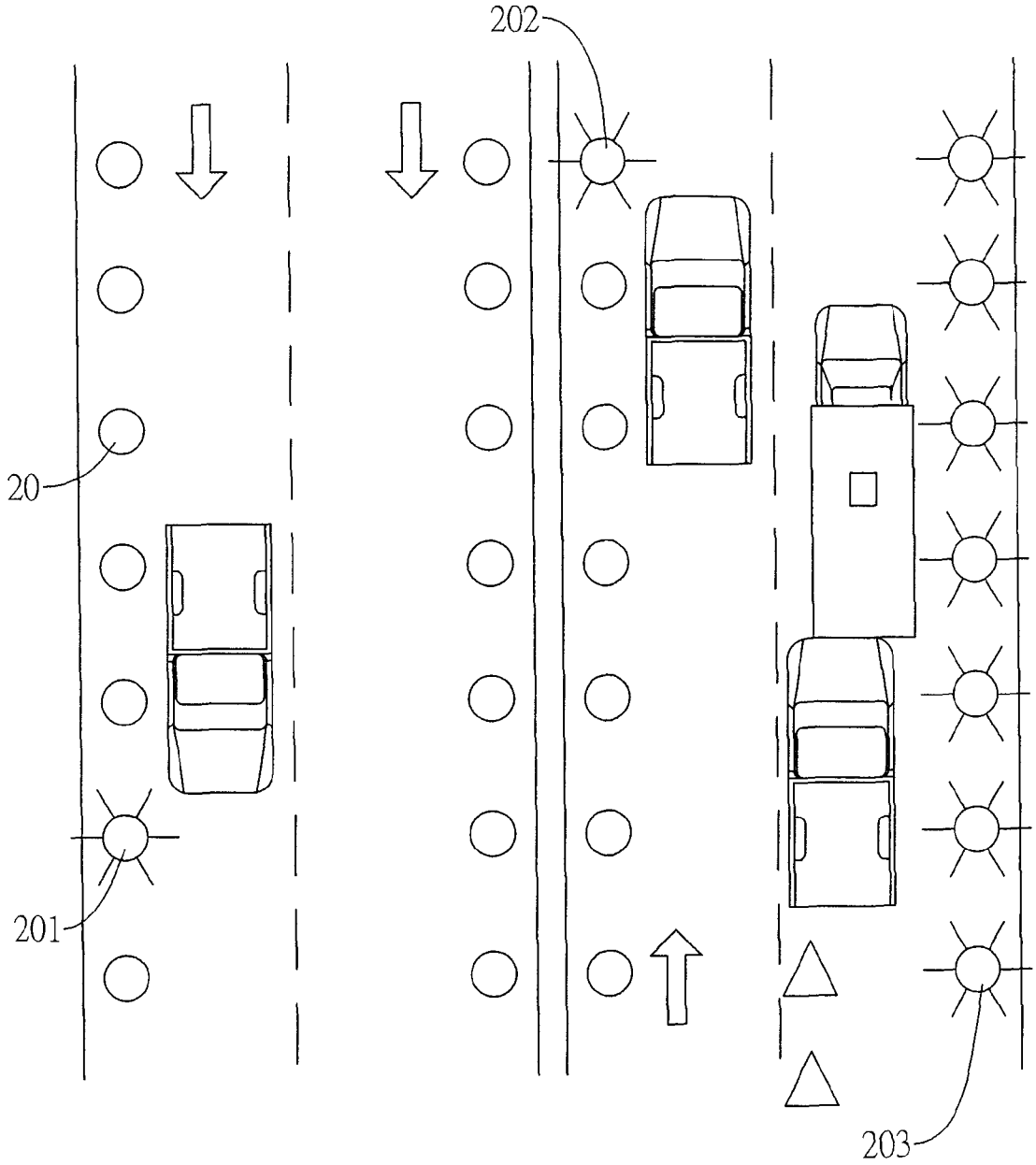
FIG. 8 is a top view of vehicles driving on a two-way multiple lanes road on which the apparatus for vehicle driving guide in FIGS. 1 or 4 is applied.

The present invention can be either applied to one-way or two-way roads that have multiple lanes. Multiple apparatuses of the present invention can be applied respectively to different lanes on the roads to guide vehicles in different directions or in different lanes. With further reference to FIG. 8, if an accident occurs on one of the lanes on a two-way road, the indication lamps (20) in the apparatus of the present invention applied to the lane with accident will emit red light (203). The indication lamps (20) in the apparatus of the present invention applied to the lane next to the lane with accident will emit yellow light (202) to warn the drivers to slow down. The indication lamps (20) in the apparatus of the present invention applied to the road with opposite direction to the lane with accident continue to emit green light (201).

Even though numerous characteristics and advantages of the present invention have been set forth in the foregoing description, together with details of the structure and function of the invention, the disclosure is illustrative only. Changes may be made in detail, especially in matters of arrangement of parts within the principles of the invention to the full extent indicated by the broad general meaning of the terms in which the appended claims are expressed.

What is claimed is:

1. An apparatus for vehicle driving guide comprising:

a traffic condition detection module obtaining a traffic condition;

multiple indication lamps being mounted separately on a target road and arranged into multiple lamp blocks; and a signal control module being electrically connected to the traffic condition detection module and the indication lamps and controlling the indication lamps according to a control process based on different traffic conditions to guide drivers in vehicles on the target road, wherein the signal control module comprises multiple sub-control modules corresponding respectively to the lamp blocks and electrically connected to the traffic condition detection module, and each sub-control module electrically connected to the indication lamps in a corresponding lamp block, receiving the traffic condition from the traffic condition detection module and transmitting a coordination signal based on the traffic condition; and a main controller connected to the sub-control modules through a multiplexer and a de-multiplexer, receiving the coordination signals from the sub-control modules, arbitrating conflicts between the sub-control modules and transmitting enable signals respectively and differentially to the sub-control modules to coordinately operate the sub-control modules;

wherein each sub-control module comprises:

a time counter;

a signal controller connected to the time counter and the indication lamps in a corresponding lamp block; and a processor electrically connected to the traffic condition detection module, the multiplexer, the de-multiplexer and the signal controller, receiving the traffic condition from the traffic condition detection module, transmitting the coordination signal based on the traffic condition to the main controller through the multiplexer, transmitting a driving signal to the signal controller in a corresponding sub-control module when receiving a corresponding enable signal from the main controller and controlling the indication lamps in the corresponding lamp block according to the control process.

2. The apparatus as claimed in claim 1, wherein:

the control process comprises a chase mode that sequentially pulses the indication lamps on with a regulated moving direction of the target road with a pulse interval between turning the indication lamps on to present an impression that the lights are moving at an indicator speed; and the time counters assist the signal controllers of the sub-control modules in the signal control module in controlling and changing the pulse interval.

3. The apparatus as claimed in claim 2, wherein the signal control module further comprises an interval setting terminal being electrically connected to the sub-control modules to allow inputting and changing the pulse interval.

4. The apparatus as claimed in claim 3, wherein the traffic condition detection module further comprises:

multiple cameras being mounted on the target road to capture traffic condition image data including vehicle images and background images; and a traffic condition determination unit being electrically connected to the cameras to receive the traffic condition image data, distinguishing the vehicle images from the background images and determining the traffic condition by tracking the vehicle images and calculating at least one traffic speed from at least one vehicle in the vehicle images.

5. The apparatus as claimed in claim 2, wherein the traffic condition detection module further comprises:

multiple cameras being mounted on the target road to capture traffic condition image data including vehicle images and background images; and a traffic condition determination unit being electrically connected to the cameras to receive the traffic condition image data, distinguishing the vehicle images from the background images and determining the traffic condition by tracking the vehicle images and calculating at least one traffic speed from at least one vehicle in the vehicle images.

6. The apparatus as claimed in claim 1, wherein the traffic condition detection module further comprises:

multiple cameras being mounted on the target road to capture traffic condition image data including vehicle images and background images; and a traffic condition determination unit being electrically connected to the cameras to receive the traffic condition image data, distinguishing the vehicle images from the background images and determining the traffic condition by tracking the vehicle images and calculating at least one traffic speed from at least one vehicle in the vehicle images.

7. A method for vehicle driving guide comprising steps of:

providing traffic condition data, wherein the traffic condition data are traffic condition image data having vehicle images and background images;

obtaining a traffic condition from the traffic condition data, wherein the step of obtaining a traffic condition has sub-steps of:

distinguishing the vehicle images from the background images in the traffic condition image data;

positioning the vehicle images;

tracking the vehicle images and calculating an average traffic speed, and at least one vehicle in the vehicle images being tracked through multiple frames so the traffic speed of the at least one vehicle is calculated and an average traffic speed is calculated from the at least one traffic speed; and determining a traffic condition being either smooth traffic or heavy traffic or traffic jam or accident from the tracked vehicle images and the average traffic speed; and operating multiple indication lamps on a target road according to a control process based on the traffic condition to guide drivers in vehicles wherein each indication lamp emits lights comprising green light, red light and yellow light, and the step of operating multiple indication lamps on a target road has sub-steps of:

controlling the indication lamps to emit green light and follow the control process in a chase mode that sequentially pulses the indication lamps on with a regulated moving direction of the target road with a pulse interval between turning the indication lamps on to present an impression that the lights are moving at an indicator speed when the traffic condition is smooth traffic, and the indicator speed being equivalent to the average traffic speed;

controlling the indication lamps to emit yellow light and follow the control process in the chase mode when the traffic condition is heavy traffic; and controlling the indication lamps to emit red light and follow a warning mode when the traffic condition is traffic jam or accident.

8. The method as claimed in claim 7, wherein the sub-step of controlling the indication lamps to emit either green or yellow lights and follow the control process in the chase mode further controls the indication lamps to be partially activated, with at least one indication lamp not being activated distributed between two indication lamps being activated.

* * * * *